United States Patent [19]

Cornelison

[11] Patent Number: 4,849,274

[45] Date of Patent: Jul. 18, 1989

[54] HONEYCOMB FLUID CONDUIT

[75] Inventor: Richard C. Cornelison, Hiram, Ohio

[73] Assignee: W. R. Grace & Co.-Conn., New York, N.Y.

[21] Appl. No.: 102,008

[22] Filed: Sep. 28, 1987

Related U.S. Application Data

[63] Continuation-in-part of Ser. No. 68,949, Jun. 19, 1987, abandoned.

[51] Int. Cl.[4] ..... B32B 3/12; B32B 7/00

[52] U.S. Cl. ..... 428/116; 428/119; 428/120

[58] Field of Search ..... 428/116, 119, 120, 469, 428/698–699

[56] References Cited

U.S. PATENT DOCUMENTS

Re. 31,405 10/1983 Paisley ..... 428/116 X
2,977,265 3/1961 Forsberg et al. ..... 428/116
3,175,937 3/1965 Bayer et al. ..... 428/116 X
3,891,575 6/1975 Brautigam et al. ..... 252/455 R
4,703,395 10/1987 Cline ..... 428/116 X

*Primary Examiner*—Nancy A. B. Swisher
*Attorney, Agent, or Firm*—Steven T. Trinker

[57] ABSTRACT

There is provided an improved honeycomb type gas conduit characterized by alternating noncorrugated aluminized ferrous metal foil and corrugated metal foil sheets in contact with each other at the apices or crests of the corrugation. The conduit has an inlet and an outlet for the gas and the honeycomb structure from 20 to 200 cells per square inch. The axes of the cells are parallel throughout their length. A hardened ceramic lip is provided at the leading edge of the cells, and preferably at the leading and trailing edges. When hardened by curing, e.g., with high temperature, the ceramic applied as a slip, forms fillets at the nips between the corrugations and the flat foil sheets, and cements the two together very tightly.

12 Claims, 1 Drawing Sheet

HONEYCOMB FLUID CONDUIT

RELATED APPLICATION

This application is a continuation-in-part of my copending application Ser. No. 068,949 filed June 19, 1987, now abandoned.

This invention relates, as indicated, to an improved honeycomb-type fluid conduit, which can be utilized in a liquid or gas stream for particulate removal or the conduct of catalytic reactions, or both, as for example in the exhaust line of an internal combustion engine which is compression or spark ignited or in an air purification system.

BACKGROUND OF THE INVENTION AND PRIOR ART

Until quite recently, honeycomb-type fluid conduits, or catalytic converter elements, have been formed of ceramic monoliths as cast bodies having a plurality of longitudinally extending chambers forming a honeycomb-like structure. A catalytic material or composition is deposited on the walls of the chambers, and as the fluid or gas passes through at exhaust temperatures, a catalyzed reaction occurs whereby harmful pollutants contained within the gas stream, e.g., unburned hydrocarbons, carbon monoxide, ozone, nitrogen oxides, etc., are largely converted to harmless gases, e.g., water, carbon dioxide, and nitrogen, and passed into the air.

The ceramic type catalytic converters, although currently widely used, have limitations that can be overcome with corrugated metal foil substrates. In the first place, in order to preserve strength, and to provide adequate surface area for the catalyst, the size of the monolith must be quite large. Automotive customers are caught in the squeeze between this size requirement and the minimum ground clearance that must be preserved in order to minimize danger from grass fire. The ceramic monoliths are also fragile and careful handling is required. Thus, it can be seen that there is a great deal of interest in catalytic converters made from corrugated ferrous metal strips. These structures are strong and with openings numbering as high as 500 per square inch, the size requirements can be such that the automotive manufacturers have much more latitude in design. Ceramic honeycombs because of the thicker cell walls have about 70% open area compared to about 90% with the metallic honeycombs. This difference means a considerably high pressure drop in the ceramic honeycombs compared to the metallic honeycombs.

These metal support catalytic converters work very well with spark ignited internal combustion engines. However, compression ignited engines pose a somewhat different problem—that of particulate emissions composed mainly of carbon. A great deal of attention is now being directed to the solution of this problem, and it is to this end that the present invention is particularly directed.

With the number of openings in the range of from 250 to 500 per square inch, and a nonnesting corrugated pattern employed, the particulates collect within the converter and unless frequently burned out, will clog the openings and either shut down the engine or cause the exhaust to be by-passed through a noncatalyst exit. To minimize clogging, it has been found desirable to reduce the density to a maximum of about 200 cells per square inch. However, when such a reduction is made, the corrugations must be larger and clogging is avoided, but it is not possible to manufacture nonnesting configurations of the metal foil. Straight through openings are, therefore, provided. This structure necessitates the use of two foil strips, a noncorrugated foil strip and a corrugated strip in juxtaposed relation. Usually, the two strips are spirally wound.

A suitable example of a basic structure of the type here contemplated is shown in the patent to Rosenberger, U.S. Pat. No. 4,300,956 dated Nov. 17, 1981. The invention in this patent relates to a means of securing the crests of the corrugations to the adjacent noncorrugated strip by metal-to-metal diffusion bonding. The present invention effects bonding by a different means with unusual advantages. This invention uses a ceramic cement as will be described below.

As indicated above, the structures of the present invention may also carry a catalytically active surface for effecting chemical reactions while the fluid is traversing the fluid conduit. Reference may be had to my copending application Ser. No. 830,698 filed Feb. 18, 1986 for description of a general process for forming and rendering catalytically active a corrugated metal strip. Although the corrugations in that patent application are of the nonnesting type and at a density higher than in the present case, the principles of fabrication and depositing the catalyst on a suitably receptive surface are essentially the same. Reference may also be had to application Ser. No. 029,661 filed Mar. 24, 1987 entitled "Catalyst Support and Method for Making Same" for a preferred method of coating the base metal with aluminum.

BRIEF STATEMENT OF THE INVENTION

Briefly stated, the present invention is in an aluminized metal foil assembly of alternating noncorrugated aluminized ferrous metal foil and corrugated aluminized ferrous metal foil sheets in contact with each other at the apices or crests of the corrugations. This arrangement is spirally wound or accordion folded to define a honeycomb fluid passageway having an inlet and an outlet and having from 20 to 200 cells per square inch, the axes of the cells being parallel to each other throughout their length. After containment of the honeycomb in a suitable peripheral retainer, such as a circular rim, the assembly is dipped into a ceramic slip of certain composition one or more times to a depth of from about ⅛" to about ½" to build up a lip on the leading and/or trailing edges of the foil strips. This coating is allowed to harden or is thermally hardened. The dipping operation and the surface tension characteristics of the slip cause the slip to form fillets in the nips between the crests of the corrugations and the adjacent noncorrugated sheet and strongly adhere the two elements together.

A very surprising attribute of this manner of fabrication is that the thickened lip formed by the ceramic on the leading and/or trailing edges has been found to keep the edges of the device much cleaner than heretofore available with untreated structures such as shown in the aforesaid U.S. Pat. No. 4,300,956. Without the ceramic lip, the edges collect dirt and soot rapidly and reduce the open area of the device. However, with the ceramic lip, this build-up is not observed and the device remains free of such deleterious collections for a much longer period of time.

BRIEF DESCRIPTION OF THE DRAWINGS

The invention may be better understood by having reference to the annexed drawings which are illustrative of a preferred embodiment of the invention, and wherein.

DETAILED DESCRIPTION OF THE INVENTION

Figure 1:
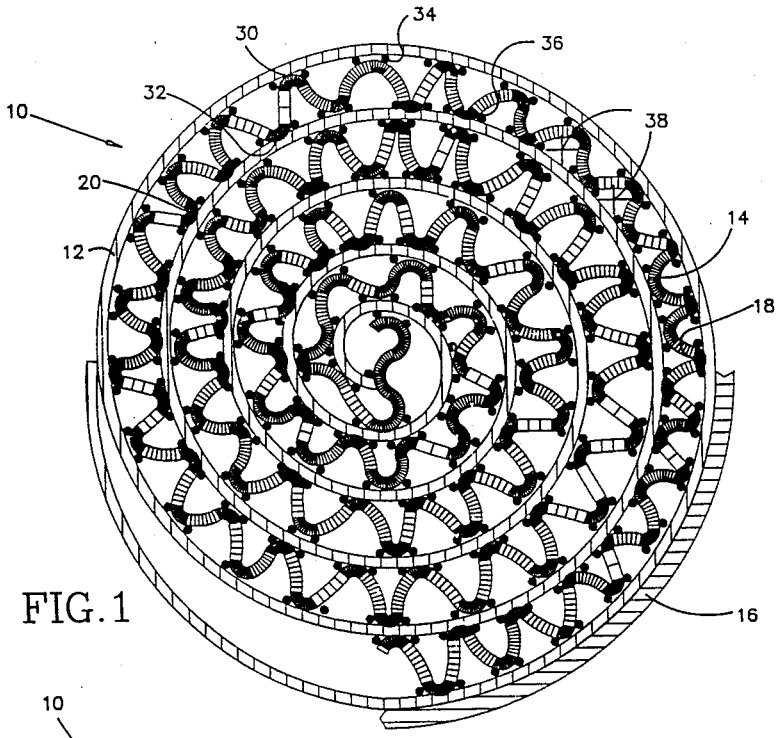
FIG. 1 is a fragmentary top view of a fluid conduit in accordance with the present invention and showing spirally co-wound noncorrugated and corrugated thin metallic strips.

As indicated above, the invention is concerned with a honeycomb-type fluid conduit characterized by noncorrugated and corrugated metal strips in juxtaposed relation and accordion folded or spirally wound, the latter being preferred. Compared to corrugated metal foil catalyst support members of recent manufacture for automotive catalytic converters, the fluid or gas conduits of the present invention are quite wide open in the sense that the density of openings per square inch is relatively low, i.e., 20 to 200, whereas the usual metallic catalyst support members have a density of from about 250 to 500 openings per square inch. Moreover, the openings of the devices of this invention are continuous and straight through whereas the openings in the catalytic converters are usually tortuous, i.e., have a herringbone pattern to prevent nesting between contiguous layers when accordion folded or spirally wound. The formation of the herringbon pattern, for comparision's sake, is fully described in the aforesaid application Ser. No. 830,698.

The formation of the corrugations in the metal foil of the present invention can be by any conventional metal corrugation means, for example, by passing the metal foil through intermeshing corrugating gears. The size of the gears of spacing between the teeth determines the pitch of the corrugations, and the depth of the root, the altitude of the corrugations.

When the devices of the present invention are to be used as a particulate trap only, e.g., for use in the exhaust line of a diesel engine, it is not essential that the surface of the metal foil be catalytically active. Often, however, it is beneficial that the surface of the metal be catalytically active. In such event, the procedure for rendering a corrugated surface catalytically active as described in my copending Ser. No. 830,698 supra may be used. The same procedure may be used for rendering the surface of the flat strip or noncorrugated strip catalytically active. In this event, the device as produced can be used not only as a particulate trap, but also as a catalytic converter to remove undesirable pollutants from engine exhaust.

The metallic substrate used herein is desirably in the form of a cold rolled or amorphous foil, wire, cloth, gauze or particles. Preferably, I use a ferritic or austenitic stainless alloy, e.g., 409 or 304 with 11 to 30 weight percent chromium and balance iron, optionally one or more of aluminum, molybdenum, titanium, columbium, hafnium, cerium, yttrium, lanthanum and zirconium. The optimum core material contains 18–25 wt. % chromium, 4–6 wt. % aluminum, 1–2 wt. % zirconium, balance iron and no more than 0.3% carbon. Also useful herein are tungsten foil, titanium foil, nickel or nickel alloy foils.

The metal foil used herein is desirably aluminized. The aluminum is applied as a very thin coating (0.000001"-0.0005") to the metal substrate, usually a stainless steel, preferably a nickel-free stainless steel such as Fecralloy or the alloy described above. The aluminum can be introduced as an alloy of iron, by dipping, or by vapor deposition or sputtering, plasma spray or in a fluidized bed. In any case, it is desirable that the aluminum contain minor amounts of cerium (0.10–0.25%) and/or zirconium (0.10–0.25%). The surface of the metal is exposed to oxygen at an elevated temperature (to about 850° F.) to oxidize at least the surface of the aluminum to alumina. This surface is porous and readily accepts and binds to an aqueous wash coat of alumina with or without a catalyst included. Suitable catalysts include platinum, palladium, rhodium, and other noble metals alone or in admixture with each other. Palladium and rhodium are commonly used together as exhaust catalysts. The wash coat is heated to fix it to the metal surface. A typical wash coat has the following composition:

| | |
|---|---|
| Calcined alumina (gamma) | 70–80% |
| Gel alumina | 15–20% |
| Ceria | 5–25% |
| Zirconia | 5–25% |

Gel alumina is usually a pseudoboehmite, $Al_2O_3 \cdot H_2O$ with considerable excess water beyond the single mole of water of hydration. The aqueous wash coat contains from 15% to 60% solids, preferably 25% solids.

A test of dispersibility of gel alumina is made by acidifying a 5% slurry of the gel alumina with nitric acid, to a maximum of 250 milli equivalents of $HNO_3$, per 100 gm of alumina, the active slurry is sheared in a blender for 20 minutes, and then centrifuged to remove particles longer than one micron. What is not collected in the centrifuge is the dispersible fraction of the alumina, and this can be as high as 98%. To make a washcoat slurry, the mixture of calcined alumina, gel alumina, and ceria is ball milled with sufficient nitric acid to give a final pH in the range of about 4–5. The purpose of the gel alumina is to make the washcoat hard and adherent after it has been calcined. The gamma alumina and the ceria have no cohesive properties of their own. Instead of ceria, yttria or zirconia may be used in equivalent quanties to the ceria.

The thickness of the washcoat has a dry film thickness between about 5 and about 50 microns preferably between about 15 t o about 40 microns depending upon the requirements of the particular application. The washcoat is most effective when it is of uniform thickness over the surface of the corrugated surface. The washcoated substrate is quite porous which permits it to absorb solutions of catalyst material quite readily.

After application of the washcoat, it is first dried in a heated column at 250° F. to 350° F. and then calcined in a vertical tube furnace at a temperature in the range of 850° F. to 950° F.

As indicated above, the coating is done with spray heads having 0.020 inch diameter orifices located to coat a strip 7 inches wide. The required air delivery is from 5 to 20 standard cubic feet per minute (scfm) through each nozzle. Any suitable exhaust blower of conventional design (not shown) may be used to carry away overspray. Overspray is often in the neighborhood of 40% and is therefore, worthy of recovery in a mass production line.

There is a number of other methods for applying the alumina slurry onto the surface of the strip including electrostatic powder spray, electrophoretic, wet electrostatic airless (spinning bell), wet electrostatic air atomized spray and mechanical airless spraying (spinning bell).

One useful method of applying a metal, metal alloy (e.g., ni-crally, a nickel, chromium, aluminum yttrium and cobalt alloy), or a metal composite, or a metal oxide coating on the metal substrate, either before or after corrugation, is the plasma spraying. After-corrugation plasma coating has the advantage that any surface imperfection or interruption can be overcoated and the integrity of the surface restablished. The substrate may be in the form of a metal foil, wire, wire screen, gauze, wire wool, or random cuttings. All of which may be corrugate by passing through corrugating gears such as described in the aforesaid Ser. No. 830,698. In some instances, the substrate may be formed from high temperature ceramic filaments. The substance from which the various forms are made include stainless steel, nichrome alloy, ni-crally, tungsten, titanium and titanium alloys, iron-nickel and iron-nickel-chromium alloys, or high temperature resistance ceramic materials.

Usually, plasma spray application utilizes a plasma spray gun for spraying a finely divided form of the coating powder. The atmosphere in which the coating occurs can be vacuum or under a shield of inert gas, e.g., argon or helium. In plasma spraying, it is usually the work piece or the substrate that is moved past one or more stationary spray guns. In plasma spray application, no drying or calcining step is required to fix the coating as the coated substrate emerges from the plasma coating chamber with these steps already performed. The coating is porous and will readily absorb catalyst.

As indicated, the calcined washcoated surface is porous and absorbs the liquid phase noble metal catalyst compositions readily. Catalyst application stations are provided (1) to impregnate in and/or deposit the washcoat solutions of compounds to near to saturation or incipient wetness (i.e., the point where the spray applied liquid just starts to run down the vertically moving strip, (2) to eliminate waste of the metal compounds and (3) to record the deposition weight of the noble metals per unit length of the strip for ultimate calculation of the weight of noble metal catalyst in each catalytic converter unit. The catalytic metal that is impregnated and/or deposited on the washcoat is selected from palladium, platinum, nickel, copper, silver, praseodymium, vanadium, etc., depends on the chemical conversion sought. For internal combustion engine exhaust conversion, the metals are palladium, platinum, and rhodium with or without cerium, and/or zirconium and mixtures of two or more of said metals of the available catalytic metals the noble or precious metals are preferred.

The compounds of the catalyst metals listed above that are dissolved in the solution that is applied to the washcoat can be any water or alcohol soluble compound including but not limited to the oxides, hydroxides, inorganic salts, (e.g., nitrates, phosphates, halides, carbonates, silicates, aluminates, etc.) and organic salts (e.g., amine salts, organic carboxylic acid salts, such as acetates, formates, butyrates, benzylates, etc.) of said metals. Water soluble ammonium salts or hydroxides of these metals are particularly useful, for example: $Pt(NH_3)_4(OH)_2$, $Pd(NH_3)_4(OH)_2$, $Rh(NH_3)_6(OH)_3$ or $Rh(NO_3)$ The ammonium hydroxide complexes can be applied from a single aqueous solution. For rhodium, the nitrate is cheaper than the ammonium hydroxide complex, but it must be applied from a separate solution because the acidic nitrate solution would react with the basic ammonium complex solution. In a fluidized bed application, these catalysts may be applied to the strip concurrently with the refractory metal oxide.

Each of the catalyst application stations includes a chamber as described in my application Ser. No. 830,698, supra. The chamber includes a closed box of chamber having a plurality of ultrasonic spray heads, and as many as 4 to 8 or more may be supplied for each side of the strip. Ultrasonic spray heads discharge a mist of the noble metal compounds, e.g., platinum, palladium and rhodium, respectively. Desirably, these metals are present in aqueous solution in the form of water soluble salts at a concentration of from 0.5% to 5.0% by weight calculated as the metal. The chamber is desirably transparent to permit visual observation of the application and monitor its uniformity. It is provided with slots for exit and entry, respectively, of the corrugated strip. The chamber is maintained under reduced pressure, e.g., 0.01 to 1.0 inch of water.

The chamber is also desirably provided with a downwardly outwardly sloped bottom surface to aid in directing overspray and fogged solution to the outer lower edges where the excess solution is collected and removed by vacuum through suitable fittings. The fittings are connected to conduits respectively, and lead into a collection and condensing chamber maintained under reduced pressure by a vacuum pump. The condensate from condenser is collected as a liquid in receiver for recycle to storage tanks which are conventional and supply the ultrasonic spray guns. The vacuum in the condensate recovery system is maintained at from 2 to 20 inches of water.

After application of the catalyst solution in each station, the strip is dried in a tunnel furnace or a vertical furnace at a temperature in the range of 200° F. to 300° F., and then the strip is passed through a vertical furnace or heater where the temperatures of the surface of the strip is elevated to from 850° F. to 950° F., whereby the noble metal is released as the zero valent metal uniformly deposited on the washcoated surface. The catalyst materials are deposited desirably singly and in sequence although plural application of catalyst metals from the same aqueous solution may be carried out albeit not as effectively. Moreover, the width of the catalyst application may desirably be less than the width of the metal strip leaving, for example one edge of the strip substantially catalyst free. Materials which tend to poison the noble metal catalysts tend to collect on the upstream or leading edges of the catalyst support core due to the high absorptive nature of the calcined refractory metal oxide coating thereon. This will prolong the effective life of the catalyst core by trapping catalyst poisons before they contaminate the balance of the core.

A station similar in construction and operation to the catalyst stations is used for applying a stabilizer, e.g., ceria, also from as aqueous solution of a water soluble salt. Drying and calcining operations as above described are performed in this station.

The foregoing operations and stations are fully described in my copending application Ser. No. 830,698 which is incorporated herein by reference. The composite substrate material thus produced is continuously accordion folded. Alternatively a core is spirally wound, using laminated flat and corrugated material, in a spiral configuration, to a cell density which ranges from 20 to 200 cells/sq. inch.

After the surface treatment such as above described is completed, the noncorrugated and corrugated strips are superimposed and, indicated above, desirably spirally wound as shown in FIG. 1 and disposed in a circular retaining band to contain the entire coil of honeycomb material. This forms the fluid conduit. After assembly in this manner, the fluid conduit is dipped into an aqueous ceramic slip having the composition given below to a depth of from about ⅛"to ½". This is dried spontaneously or by application of heat. Several applications of the ceramic slip may be made if desired or deemed necessary for the best adhesion. When the ceramic adhesive has dried, it forms a strongly adherent bond with the surface of the metal foils and in particular at the nips where the crests of the corrugations of the corrugated foil contact the flat surface of the noncorrugated foil.

The cement slip has sufficient liquid tension and adhesion qualities to cement adjacent contacting points of the corrugated laminations of foil together, the cement adhering well to the alumina surface on the aluminum-coated substrate but not increasing the face area or drag in the system appreciably. Such cements are aqueous dispersions of sodium silicate and phosphate bonded monomagnesium, e.g., an electric resistance cement No. 78 produced by Sauereisen Cements Co. This material has essentially the same coefficient of thermal expansion as a ferritic base metal and is stable to temperatures of 2600° F. The ceramic cements useful herein are stable at temperatures of from 1800° F. to about 2700° F.

The cement further serves as a barrier to corrosion to the exposed edges of the core substrate material in honeycomb cores.

Surprisingly, whereas sharp metallic edges encountering flowing diesel gases collect soot and other entrained materials in exhaust gas, the dipped reading edges do not trap such particles even though of very thin cross-section.

Numerous high temperature ceramic cements are known, a typical example of which is taught in U.S. Pat. No. Re. 31,405 dated Oct. 4, 1983, preferably omitting the foaming agent for the purposes of this invention. The composition disclosed in Column 4 of U.S. Pat. No. 3,979,625 may also be used.

Reference may be had to the annexed drawings which show a preferred embodiment of the present invention. In FIG. 1 there is shown in partial end view of a honeycomb fluid conduit 10 formed of co-wound noncorrugated metal foil 12 in juxtaposed relation with corrugated metal foil 14 to form a spirally wound member. A retainer ring 16 surrounds the spirally wound member. It will be observed that the crests 18 and 20 are in contact with the noncorrugated metal strip 12.

Figure 2:
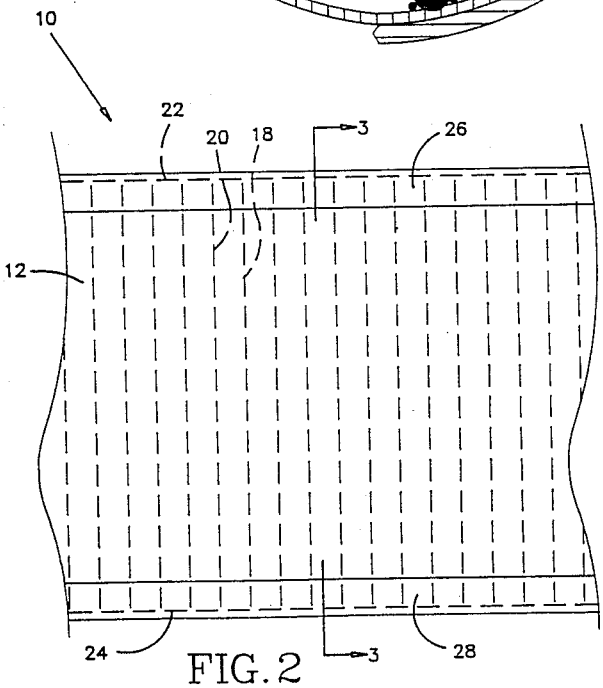
FIG. 2 is a partial end view of the fluid conduit shown in FIG. 1 and showing the ceramic coating along the leading and trailing edges.
Figure 3:
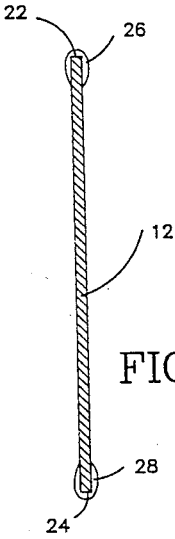
FIG. 3 is a cross-sectional view through a single convolution as it appears in the plane indicated by the line 3—3 in FIG. 2 and showing the marginal beads of ceramic.

As shown in FIG. 2 with the retaining ring 16 removed, there is here shown as terminal fragments, the fluid conduit 10 which has been assembled and dipped on the leading edge 22 and on the trailing edge 24 (with reference to the direction of fluid flow through the device) to provide beads 26 and 28 (FIG. 3) on the edges 22 and 24, respectively.

As best shown in FIG. 1, the nips 30 and 32 between the outer crests 18 and the inner crests 20, and the noncorrugated metal strip 12, when dipped in the ceramic slip develop on curing, fillets 34 and 36 which tightly bond the members together.

As indicated above, not only are the noncorrugated and corrugated metal members tightly bonded together with a ceramic cement without the necessity for metal-to-metal fusion or soldering, but the lip 26 formed on the leading edge 22 appears to act as an air foil and in some unexplained way prevents the buildup of particulates on the leading edge with the ultimate at least partial blocking of the honeycomb.

The devices of the present invention have the axes 38 which are parallel and in the embodiment shown in FIG. 1 are also parallel to the axis of the fluid conduit 10. The axes 38, although parallel to each other, need not be parallel to the axis of the conduit 10 and may be oblique thereto.

The devices of this invention may have any axial length, and if spirally or convolutely wound, any diameter. The metal foil is conveniently from 0.001" to 0.202" in thickness.

The corrugated improved catalytically active composite is then disposed in a suitable chamber, e.g., a canister or tube, inserted in an exhaust line of an internal combustion engine, or in a chemical process line in which ingredients reactive in the presence of a catalyst are flowing (e.g., gas-gas, liquid-gas, liquid-liquid, gas alone, liquid alone, solid-gas, solid-solid, phases) or utilized as a free flowing powder in a reaction vessel in accordance with known techniques.

What is claimed is:

1. An aluminized ferrous metal foil assembly of alternating noncorrugated aluminized ferrous metal foil and corrugated aluminized ferrous metal foil sheets in contact with each other at the apices of said corrugations, and defining a honeycomb gas passageway having an inlet and an outlet, said honeycomb having from 20–200 cells per square inch, the axes of said cells being parallel to each other throughout their length, and a hardened ceramic lip coating on at least one outer edge, and extending into the nips between the noncorrugated and corrugated ferrous metal sheets to cement the noncorrugated and corrugated strips together.

2. An aluminized ferrous metal foil body as defined in claim 1 wherein the body is convolute wound.

3. An aluminized ferrous metal foil body as defined in claim 1 wherein the ceramic lip coating is formed from a slip containing gamma alumina and gel alumina.

4. An aluminized ferrous metal foil body as defined in claim 1 wherein the surfaces of the noncorrugated and corrugated foil members have a catalytically active surface thereon.

5. An aluminized ferrous metal foil body as defined in claim 1 wherein the ferretic foil is aluminized with vapor deposited aluminum.

6. An aluminized ferrous metal foil body as defined in claim 5 wherein the aluminized ferritic foil is provided with a calcined washcoat of alumina.

7. An aluminized ferrous metal foil body as defined in claim 6 wherein the alumina is a plasma coating.

8. An aluminized ferrous metal foil body as defined in claim 6 wherein the calcined washcoat has impregnated therein a catalytically active metal.

9. An aluminized ferrous metal foil body as defined in claim 8 wherein the catalytically active metal is a noble metal.

10. An aluminized ferrous metal foil body as defined in claim 9 wherein the noble metal is palladium.

11. An aluminized ferrous metal foil body as defined in claim 1 wherein the ferrous metal foil is a stainless steel foil.

12. An aluminized ferrous metal foil body as defined in claim 1 wherein the ferrous metal foil is a ferritic stainless steel foil.

* * * * *